United States Patent [19]

Gotanda

[11] Patent Number: 4,679,834

[45] Date of Patent: Jul. 14, 1987

[54] DOOR UNLOCKING DEVICE

[76] Inventor: Motohiro Gotanda, 1802-10, Nakabyo, Abiko-shi, Chiba-ken, Japan

[21] Appl. No.: 804,085

[22] Filed: Dec. 3, 1985

[51] Int. Cl.[4] ..... E05C 1/06

[52] U.S. Cl. ..... 292/169.13; 292/254

[58] Field of Search ..... 292/169.13, 254, 341.16, 292/341.17, 335

[56] References Cited

U.S. PATENT DOCUMENTS 3,917,329 11/1975 Fujiki et al. ..... 292/169.13 X 4,529,234 7/1985 Senften ..... 292/254 X

*Primary Examiner*—Richard E. Moore

*Attorney, Agent, or Firm*—Stephen F. K. Yee

[57] ABSTRACT

A device for unlocking a door locked with a door lock apparatus of a type which is comprised of a latch bolt and a trigger bolt capable of locking the latch bolt and of preventing the latch bolt from being retracted when the door is closed. The unlocking device is mounted on a door frame supporting the door and includes a strike having openings through which the trigger and latch bolts are inserted, and a stopper plate moveable between a service position where it is engaged by the trigger bolt to prevent trigger bolt from protruding from the strike and a non-service position where the trigger bolt is permitted to protrude from the strike so as to release the locking of the latch bolt with the trigger bolt. The stopper plate is moved by a solenoid actuated by remote control. The unlocking device is further provided with a pushing member which moves the latch bolt, which has been released from the trigger bolt, out of the strike, whereby the door may be opened by mere pushing without rotating a door knob.

7 Claims, 12 Drawing Figures

DOOR UNLOCKING DEVICE

This invention relates to a device for unlocking a door locked with a door lock apparatus capable of automatically locking the door when the door is closed.

There are known a lot of door lock apparatuses which can automatically lock the door when the door is closed. FIG. 11 in the accompanying drawings shows one such door lock apparatus which includes a front plate 128 to be fixed to one side edge of a door (not shown), flush therewith, and outer and inner door knobs 103 and 104 to be secured to outside and inside surfaces of the door, respectively. Designated as 111 is a latch bolt which is adapted to be displaced between a first position where one end portion of the latch bolt 111 is protruded from the front plate 128 and a second position where the latch bolt 111 is retracted therefrom, which is normally urged to be displaced toward the first position and which is cooperable with the inner door knob 104 so that the latch bolt 111 may be displaced to the second position by rotation of the inner door knob 104. The reference numeral 119 denotes a trigger bolt which is adapted to be displaced between an extended position where one end portion of the trigger bolt 119 is protruded from the front plate 128 and a retracted position where the trigger bolt 119 is retracted therefrom, which is normally urged to be displaced toward the extended position, which is engageable with the latch bolt 111 so that the movement of the latch bolt 111 from the first to second position necessarily causes the movement of the trigger bolt 119 from the extended to retracted position, and which is capable of acting on the latch bolt 111 when the trigger and latch bolts are in the retracted and first positions, respectively, so that the latch bolt 111 is locked and prevented from being displaced from the first to second position, the locking of the latch bolt 111 with the trigger bolt 119 being released by rotation of the inner door knob 104 or by displacing the trigger bolt 119 to the extended position. The outer door knob 103 is either of a fixed type which is not operatively connected to the latch bolt 111 and is always incapable of displacing the latch bolt 111 or of a semi-fixed type incapable of displacing the latch bolt 111 only when a push button (not shown) optionally provided in the axis of the inner door knob 104 is pushed. A key hole 102 is provided in the outer door knob 103. When a key 106 is inserted into the key hole 102 and is rotated, the latch bolt 111 is displaced from the first to second position.

The door lock apparatus shown in FIG. 11 operates as follows. When the door is in an open position, both latch and trigger bolts 111 and 119 are protruded from the front plate 128 as shown in FIG. 11. When the door is swung for closure, the latch bolt 111 is brought into engagement with a strike (not shown) of a door frame (not shown) and is moved toward its retracted position together with the trigger bolt 119. When the door is fully closed, the latch bolt 111 extends through an opening of the strike and returns to the extended, first position. The trigger bolt 119 is, however, in engagement with the strike and is maintained in the retracted position. Thus, the latch bolt is locked with the trigger bolt 119 and the door cannot be opened from outside without using the key 106 when the push button is pushed in the case of the semi-fixed type outer door knob 103. Namely, the latch bolt 111 is prevented from being displaced toward the second position even when a thin plate or wire is inserted into the slit between the front plate and the strike and manipulated for attempting the displacement of the latch bolt 111. The latch bolt 111 may be displaced from the first to second position by turning the inner door knob 104 or by means of the key 106 to permit the door to be opened.

With the above-described door lock apparatus, it is necessary for someone in the inside of the door to rotate the inner door knob 104 in order to open the door in response to a call of a visitor. The present invention contemplates the provision of a device for unlocking a door lock apparatus of the above-mentioned type by remote control.

In accordance with the present invention there is provided a device for unlocking a door locked with a lock apparatus which comprises a front plate adapted to be fixed to one side edge of the door; outer and inner door knobs adapted to be secured to outside and inside surfaces of the door, respectively; a latch bolt which is adapted to be displaced between a first position where one end portion of the latch bolt is protruded from the front plate and a second position where the latch bolt is retracted therefrom, which is normally urged to be displaced toward the first position and which is cooperable with the inner door knob so that the latch bolt may be displaced to the second position by rotation of the inner door knob; and a trigger bolt which is adapted to be displaced between an extended position where one end portion of the trigger bolt is protruded from the front plate and a retracted position where the trigger bolt is retracted therefrom, which is normally urged to be displaced toward the extended position, which is engageable with the latch bolt so that the movement of the latch bolt from the first to second position necessarily causes the movement of the trigger bolt from the extended to retracted position, and which is capable of acting on the latch bolt when the trigger and latch bolts are in the retracted and first positions, respectively, so that the latch bolt is locked and prevented from being displaced from the first to second position, the locking of the latch bolt with the trigger bolt being released by displacing the trigger bolt to the extended position; aid device comprising:

a casing having a strike and adapted to be mounted on a door frame with the strike flush with the surface of the door frame;

a first opening provided in said strike at a position so that when the door is closed the latch bolt can enter said first opening and can be positioned at said first position;

a second opening provided in said strike at a position so that when the door is closed the trigger bolt can enter said second opening and can be positioned at said extended position;

stopper means provided within said casing and adapted to be displaced between a service position where the trigger bolt is engaged by said stopper means and is prevented from being positioned at said extended position when the door is closed and a non-service position where the trigger bolt is permitted to be positioned at said extended position;

pushing means provided within said casing, adapted to be displaced between a first location and a second location and capable of displacing the latch bolt which is positioned at said first position to said second position by its movement from said first location to said second location when the door is closed;

means for moving said stopper means between said service and non-service positions; and means for moving said pushing means between said first and second locations.

The present invention will now be described in detail below with reference to the accompanying drawings, in which.

Figure 1:
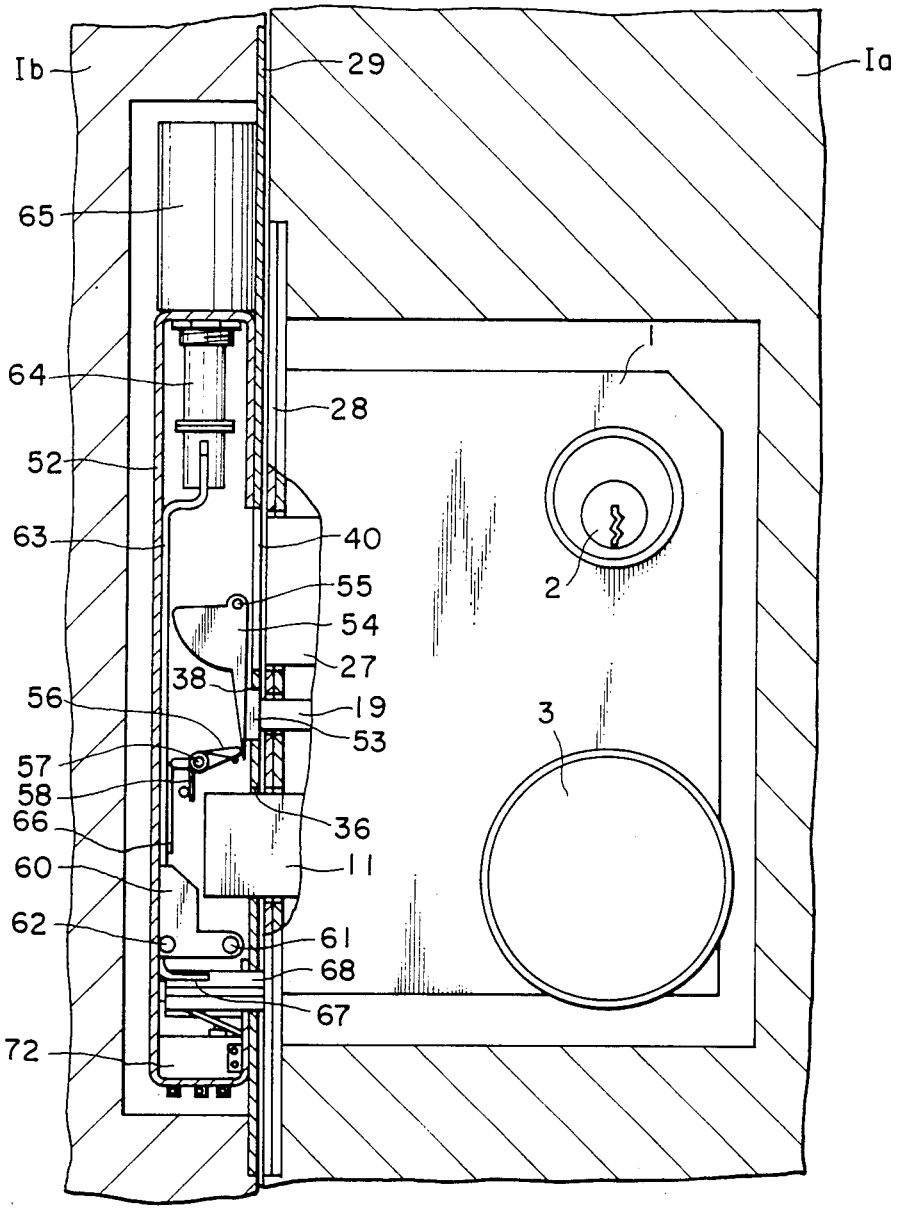
FIG. 1 is an elevational view, partly in cross-section, diagrammatically showing door unlocking device according to the present invention mounted to a door frame to which a door having a locking apparatus is supported.
Figure 3A:
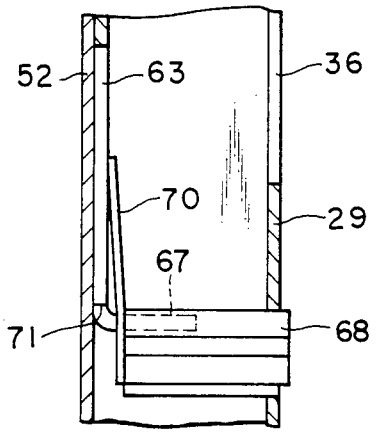
Figure 3B:
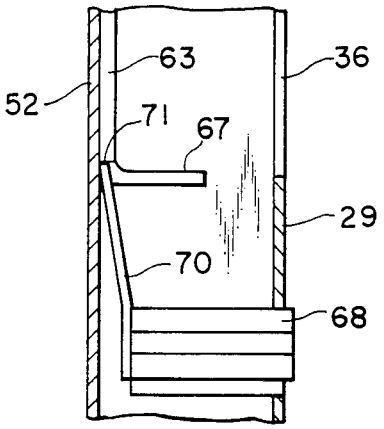
Figure 6:
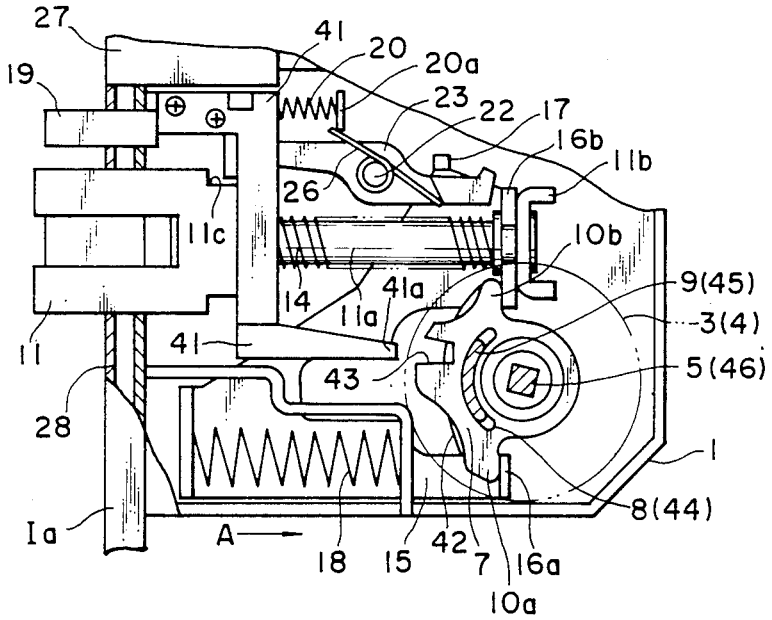
Figure 4:
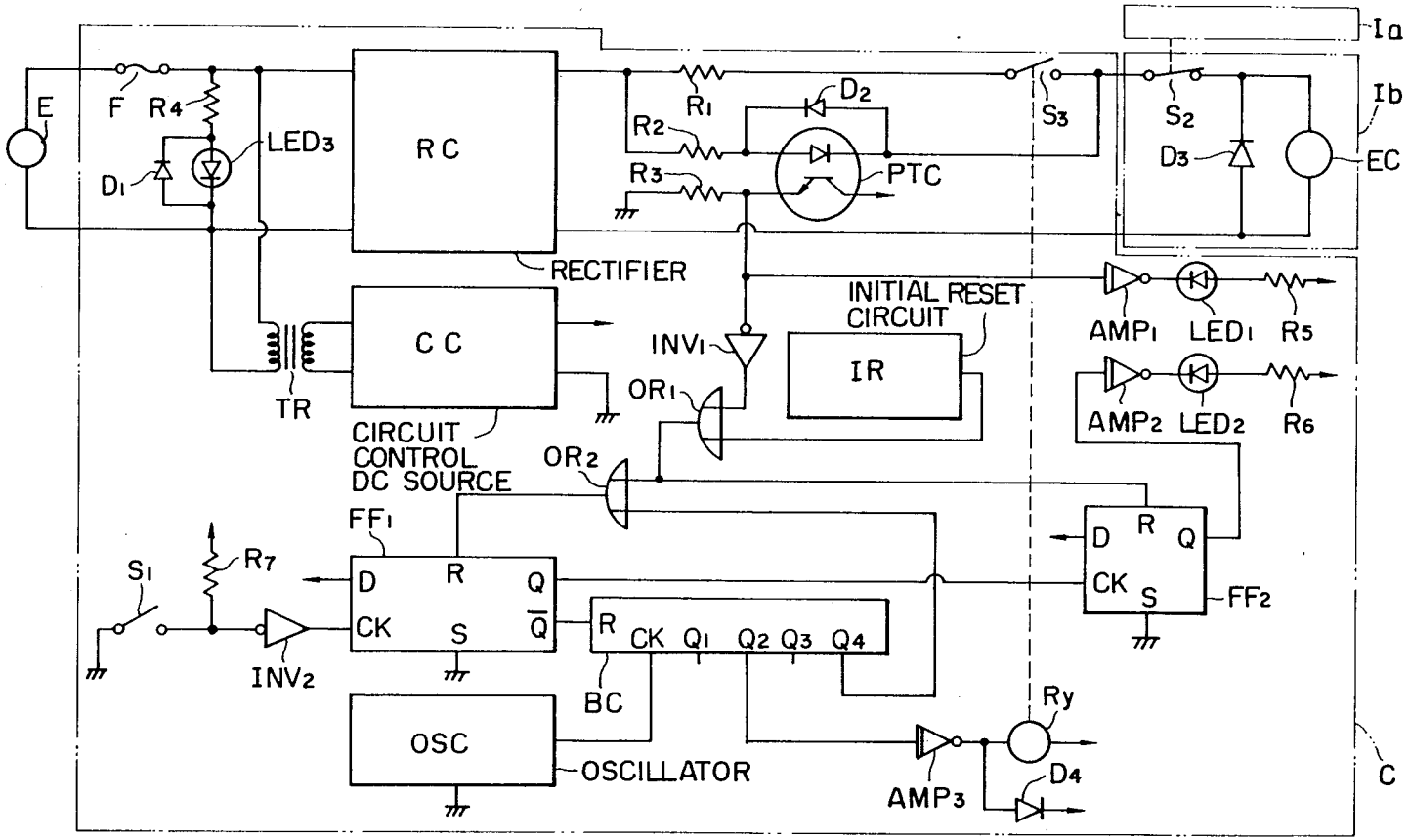
Figure 5:
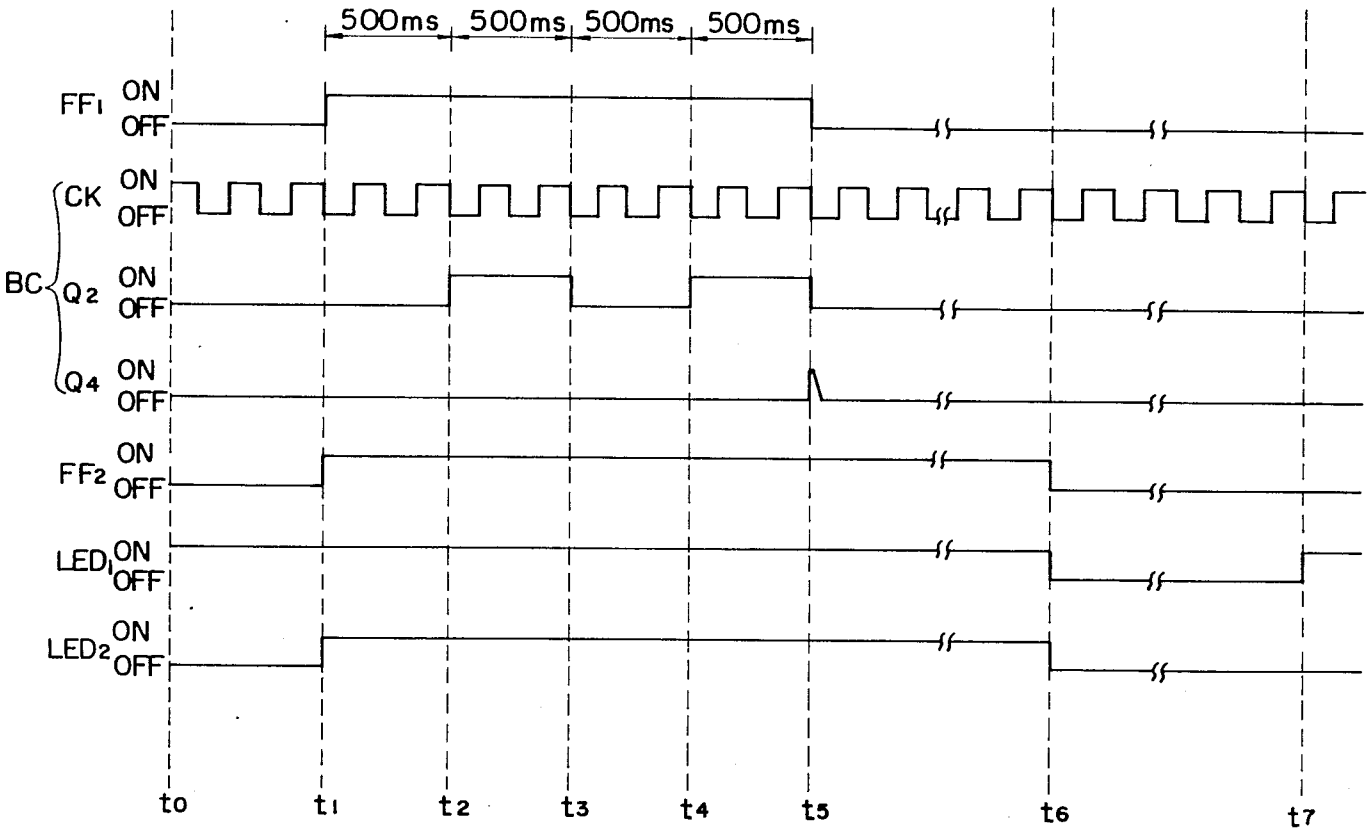
Figure 7:
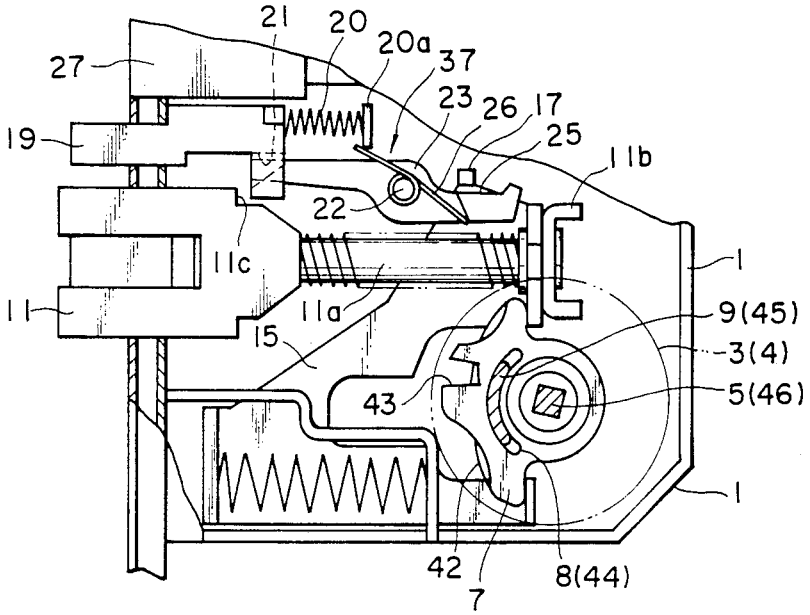
Figure 8:
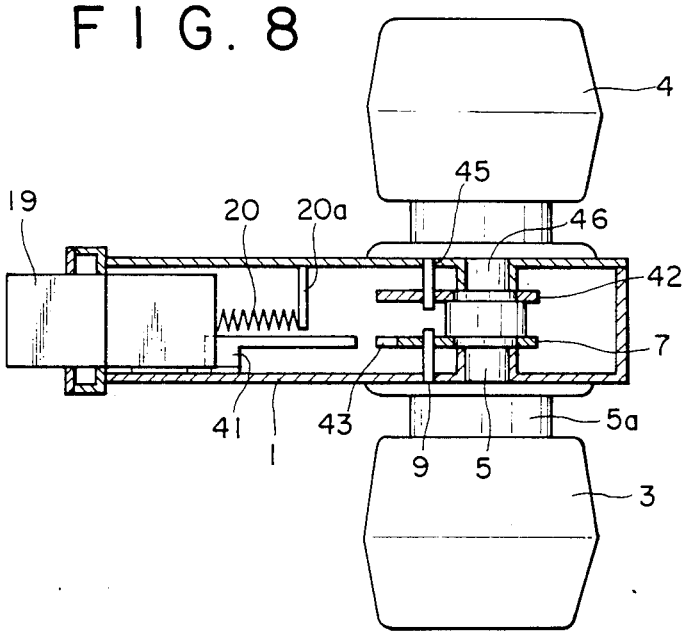
Figure 9:
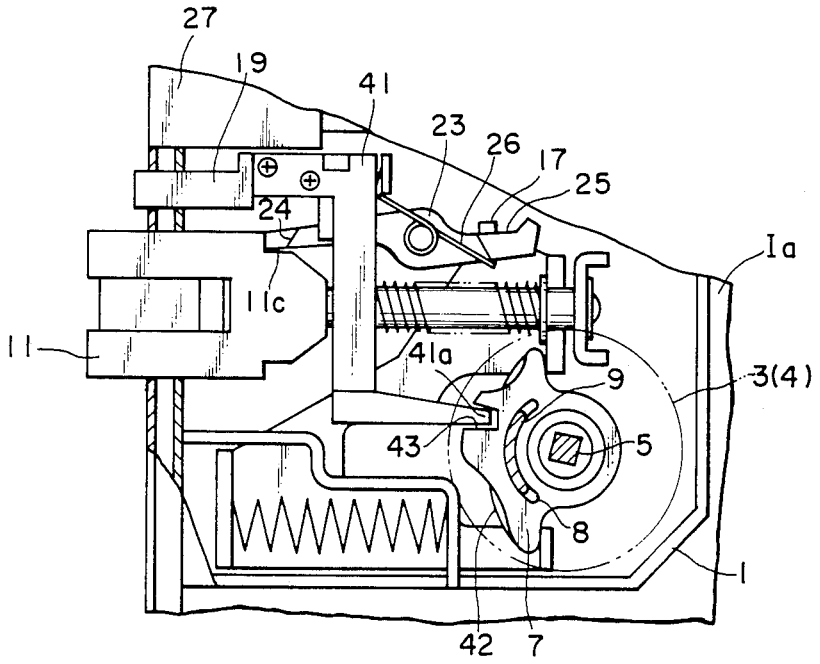
Figure 10:
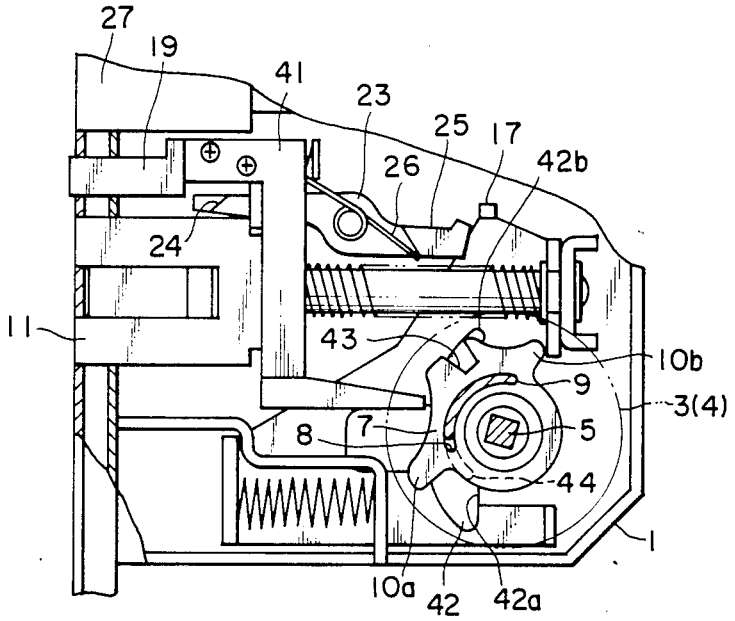
Figure 11:
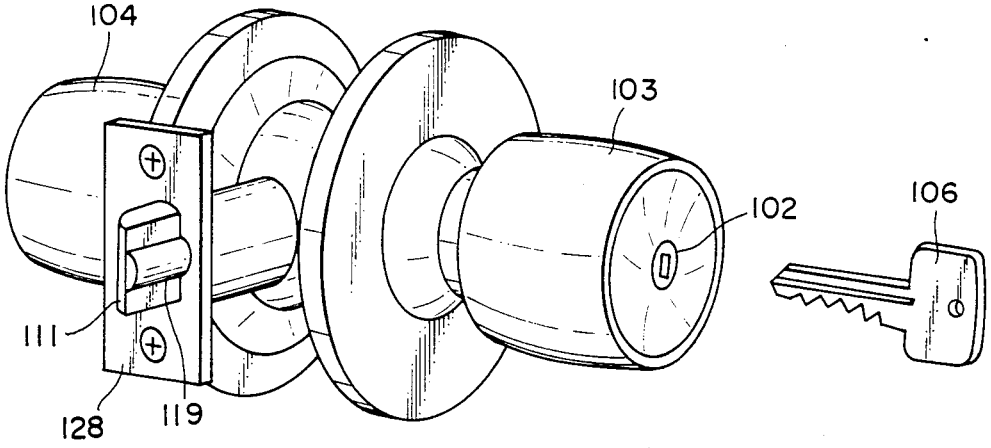
FIG. 11 PRIOR ART

FIGS. 3(*a*) and 3(*b*) are explanatory views showing the operation of an engaging plate of the device of FIG. 1;

FIG. 4 is a circuit diagram for the actuation of a solenoid of the device shown in FIG. 1;

FIG. 5 is a timing chart showing the operation of some components of the circuit diagram of FIG. 4;

FIG. 6 is an elevational view showing one example of a door lock apparatus mounted on the door;

FIGS. 7, 9 and 10 are views showing the operation of the door lock apparatus of FIG. 6;

FIG. 8 is a top view, partly in cross-section, diagrammatically showing the arrangement of stopper means; and FIG. 11 is a perspective view showing an example of a conventional door lock apparatus.

FIGS. 6 and 7 depict a door lock apparatus to which the door unlocking device of the present invention is suitably applied. For the purpose of easy understanding, a stopper plate which will be described hereinafter is removed from FIG. 7. The reference numeral Ia denotes a door hinged to a door frame Ib in any conventional manner and equipped with the door lock apparatus. The door lock apparatus includes a casing 1 having a front plate 28 fixed to one side edge of the door Ia and flush therewith. The casing 1 accommodates a latch bolt 11, a trigger bolt 19 and, if desired, a dead bolt 27. As best seen from FIG. 8, a shaft 5 is rotatably received by the casing 1 and has an enlarged portion 5*a* to which an outer door knob 3 and an actuating member 9 are fixedly mounted for rotation with the shaft 5. Rotatably supported by the shaft 5 is a rotatable plate 7 having an arched slot 8 with which the actuating member 9 is engaged. In a similar manner, an inner door knob 4 and an actuating member 45 are connected to a shaft 46 for rotation therewith. A rotatable plate 42 having an arched slot 44 is supported by the shaft 46. The slot 44 is engaged with the actuating member 45.

Referring again to FIGS. 6 and 7, a retractor 15 is slidably provided within the casing 1. The retractor 15 is normally urged to the left as seen in FIG. 6 by means of a spring 18 and has lower and upper bent portions 16*a* and 16*b* with which are engaged a pair of lobes 10*a* and 10*b*, respectively, of the rotatable plate 7. The bent portions 16*a* and 16*b* are also engageable with a pair of lobes 42*a* and 42*b* of the rotatable plate 42 FIG. 10. As a result of the above construction, when the shaft 5 or 46 is rotated in either direction by rotation of the outer door knob 3 or inner door knob 4, the rotatable plate 7 or 42 is rotated in the same direction as that of the knob, with the retractor 15 being moved in the direction A (rightward) against the tension of the spring 18.

The latch bolt 11 has a shaft 11*a* slidably received by an opening 16*c* of the bent portion 16*b*. The rear end of the shaft 11*a* is formed into a flange 11*b*. A spring 14 is mounted on the shaft 11*a* so that the latch bolt 11 is normally urged to move leftward relative to the bent portion 16*b*. Since the pushing strength of the spring 14 is weaker than the spring 18, the retractor 15 is always urged to move leftward. Thus, when the retractor 15 is moved in the direction A by rotation of either of the inner and outer door knobs 4 and 3, the latch bolt 11 is displaced to its retracted, first position where the latch bolt 11 is retracted from the front plate 28 as shown in FIG. 10. When the door knob is released, the retractor 15 is moved leftward by the action of the spring 18 until both of the lobes 10*a* and 10*b* (or 42*a* and 42*b*) are brought into engagement with the bent portions 16*a* and 16*b*, respectively, with the simultaneous leftward movement of the latch bolt 11, by the action of the spring 14, to its extended, second position where the latch bolt 11 is protruded from the front plate 28.

Lock means 37 are provided for preventing the latch bolt 11 located in the extended position from being displaced rightward when the door Ia is in the closed state. As shown in FIG. 7, the lock means 37 include a lever 23 rockably supported by a shaft 22 fixed to the casing 1. A spring 26 is mounted on the lever 23 so that the lever 23 is always urged to rotate counterclockwise. The counterclockwise rotation of the lever 23 is restricted by contact of the fore end thereof with the latch bolt 11. The lever 23 has its one end adapted for engaging with a stepped portion 11*c* of the latch bolt 11. In the engagement state, the latch bolt 11 is prevented from being moved rightward and is maintained in the extended state, as seen in FIG. 9.

The engagement between the stepped portion 11*c* of the latch bolt 11 and the lever 23 can be resolved when the lever 23 is rotated clockwise. This can be achieved by the action of the trigger bolt 19 or an engaging member 17 provided at the upper portion of the retractor 15.

The trigger bolt 19 has a front end capable of protruding from the front plate 28 and a rear end connected to one end of a spring 20. The other end of the spring 20 is fixed to a stationary plate 20*a* secured to the casing 1. Thus the trigger bolt 19 is normally urged to move leftward. The trigger bolt 19 has a notch 21 arranged for engaging with a wedge-like member 24 of the lever 23. In the state as shown in FIG. 9, when the trigger bolt 19 is moved leftward by the action of the spring 20, the wedge 24 of the lever 23 comes into engagement with the notch 21 of the trigger bolt 19. As a result, as shown in FIG. 7, the lever 23 is rotated clockwise to disengage the front edge of the lever 23 from the stepped portion 11*c* of the latch bolt 11.

The engagement between the lever 23 and the latch bolt 11 may be also resolved when the retractor 15 is moved rightward in the direction A. That is, the engaging member 17 of the retractor 15 is arranged for engaging with the upper face 25 of the lever 23. By the movement of the retractor 15 in the direction A, the upper face 25 is pushed downward by the engaging member 17, so that the lever 23 is rotated clockwise to disengage the lever 23 from the latch bolt 11. Therefore, the latch bolt 11 is permitted to move to the retracted position.

The stepped portion 11*c* of the latch bolt 11 is also arranged to engage with the trigger bolt 19 so that the movement of the latch bolt 11 from the extended position to the retracted position always causes the movement of the trigger bolt to the retracted position.

As described previously, the retractor 15 is moved by rotation of the outer or inner door knob 3 or 4. To prevent unlocking of the latch bolt 11 with the lever 23 by the disengagement between the edge of the lever 23 and the stepped portion 11*c* of the latch bolt 11 by turning of the outer door knob 3, the trigger bolt 19 is provided with a stopper plate 41. The stopper plate 41 has its one end 41*a* engageable with a groove 43 of the rotatable plate 7 when the trigger bolt 19 is located at the retracted position. The engagement of the stopper plate 41 with the groove 43 is resolved when the trigger bolt 19 is moved to its extended position as shown in FIG. 6.

The above-described door lock apparatus operates as follows. When the door Ia is in an open state, the latch bolt 11 and the trigger bolt 19 are positioned in the extended positions as shown in FIG. 7. In this state, the lever 23 is engaged by the notch of the trigger bolt 19 and is prevented from engaging with the latch bolt 11.

When the door is closed, the latch bolt 11 is protruded from the front plate 28 and positioned in the extended position as shown in FIG. 9. However, the trigger bolt 19 is displaced to the retracted position because of the engagement of the trigger bolt 19 with a strike (not shown) of the door frame side. Thus, the engagement between the trigger bolt 19 and the lever 23 is resolved, the lever 23 is rotated counterclockwise so that the edge of the lever 23 is engaged by the stepped portion 11*c* of the latch bolt. At the same time, the stopper 41 is brought into engagement with the groove 43 of the rotatable plate 7 to lock the outer door knob 3.

The door Ia in the locked state as illustrated in FIG. 4 may be opened by turning the inner door knob 4, By turning the knob 4, the retractor 15 is displaced in the direction A with the lever being rotated clockwise by the engagement between the engaging member 17 of the retractor 15 and the upper face 25 of the lever 23. Thus, the edge of the lever 23 is disengaged from the step portion 11*c* of the latch bolt to permit the movement of the latch bolt to the retracted position by rotation of the inner or outer door knob 4 or 3.

Alternatively, the door in the closed state as shown in FIG. 9 may become openable if the trigger bolt 19 is displaced to the extended position. In this case, since the outer door knob 3 becomes rotatable as a result of the disengagement of the stopper plate 41 from the groove 43 of the rotatable plate 7, the latch bolt 11 may be displaced to the retracted position by rotation of the outer door knob 3 as shown in FIG. 10.

The locked door Ia may be also opened by using a key (not shown). For example, the key inserted into a key hole is rotated to first retract the dead bolt 27 from the front plate 28 and then rotate a lever (not shown) operatively connected to the retractor 15 for the displacement of the retractor 15. The movement of the retractor 15 in the rightward direction causes the clockwise rotation of the lever 23, which in turn results in the disengagement of the lever 23 with the stepped portion 11*c* of the latch bolt 11. Thus, the door Ia may be opened by turning the outer door knob 3.

The door equipped with the door lock apparatus described in the foregoing may be automatically locked when the door is closed by the action of the trigger bolt. Such a door lock apparatus is unlocked by remote control with the device according to the present invention.

Figure 2:
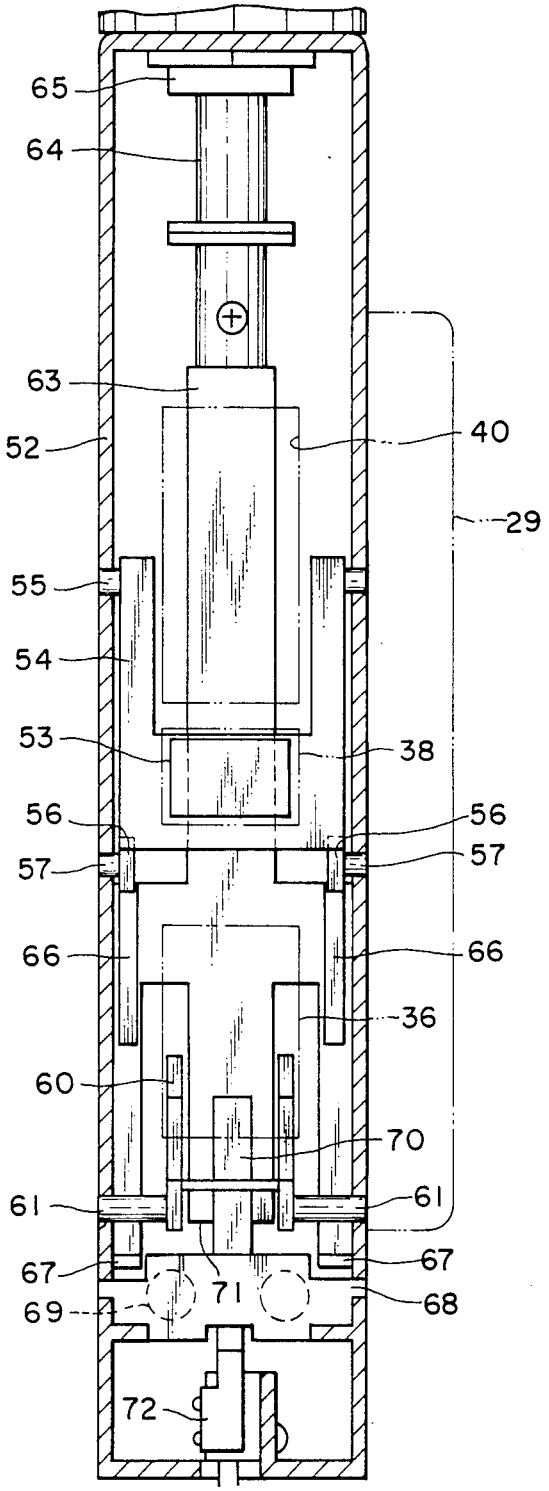
FIG. 2 is a side view, cut away in part, of the device shown in FIG. 1.

Referring now to FIGS. 1 and 2, the unlocking device in accordance with the present invention is mounted in a door frame Ib. The device includes a casing 52 having a strike 29. The strike is provided with first, second and, if necessary, third openings 36, 38 and 40 at positions so that the latch bolt 11, trigger bolt 19 and optionally provided dead bolt 27 may extend therethrough within the casing 52.

The reference numeral 54 designates a rotatable stop plate rotatably supported within the casing 52 and having a stop portion 53 adapted for engagement by the trigger bolt 19 and for preventing the entrance of the trigger bolt 19 into the casing 52 through the opening 38 when the rotatable stop plate 54 is in a service position as shown in FIG. 1. Designated as 55 is a shaft of the stop plate 54 rotatably received by the casing 52 so that the stop plate 54 may be rotated with the shaft 55 as the rotational axis between the service position and a non-service position where the stop plate 54 permits the trigger bolt 19 to enter the opening 38.

A lever member 56 is provided for maintaining the stop plate 54 in the service position. The lever member 54 is rockably supported within the casing 52 and is normally urged to rotate counterclockwise by means of a formed spring 58. The lever member 56 has its one end adpated for engaging with the stop plate 54. The stop plate 54 is maintained in the service position when in engagement with the lever member 56. The other end of the lever member 56 is arranged to be in pressure engagement with a step portion 66 of an operating plate 63. The operating plate 63 is operatively connected to a solenoid 65 by means of a plunger 64 and is capable of displacing upward to an upper position by the actuation of the solenoid 65 and downward to a lower position by gravity when the solenoid is not actuated. The solenoid 65 is controlled to actuate for a predetermined short period of time, e.g. 0.5 sec, by turning a switch (not shown) provided in the room.

Becasue of the pressure engagement between the lever member 56 and the operating plate 63, the movement of the operating plate between the upper and lower positions causes rocking movement of the lever member 56 about its axis 57. In the lower position, the lever member 56 is engageable with the stopper plate 54 to maintain the stopper plate 54 in the service position. When the operating plate 63 is moved to the upper position, the lever member 56 is rotated clockwise against the action of the spring 58 so that the lever member 56 is disengaged from the rotatable stopper plate 54, permitting the trigger bolt 19 to protrude into the casing 52 by the action of the spring 20 (FIG. 7).

Means are provided for holding the operating plate 63 in the upper position during the closure of the door Ia even after the termination of the actuation of the solenoid 65. The operating plate holding means include a latch 68 supported in the casing 52 and capable of displacing between an extended location where it is protruded from the casing 52 and a retracted location where it is retracted within the casing 52, a spring 69 for normally urging the latch 68 to displace to the extended location, and an engaging plate 70 having its one end fixed to the latch 68 and the other end adapted for engaging with the operating plate 63, which is positioned in the upper position, for maintaining the operating plate 63 in the upper position when the latch 68 is in the retracted location. As shown in FIGS. 3(*a*) and 3(*b*), the engaging plate is formed of a plate spring so that, when the latch 68 is in the retracted location, the free end of the engaging plate 70 is urged to press the operating plate 63 located in the lower position as shown in FIG. 3(*a*). The engaging plate 70 is brought into engagement with an end portion 71 of the operating plate 63 when the operating plate is displaced to the upper position as shown in FIG. 3(*b*), thereby to maintain the operating plate 63 in the upper position even when the actuation of the solenoid 65 is terminated.

Referring again to FIGS. 1 and 2, designated as 60 is an L-shaped pushing member having its one end rotatably supported by the casing 52 and its the other end adapted for engaging with the latch bolt 11 positioned in the extended position and for pushing same to the retracted position by rotation of the pushing member 60. An engaging rod 62 is fixedly or rotatably secured to the pushing member 60 and is arranged to engage with a bent portion 67 of the operating plate 63. When the operating plate 63 is displaced from the lower to upper position, the engaging rod 62 is engaged by the bent portion 67 to cause the pushing member 60 to rotate about its axis 61. As a result, the end portion of the pushing member 60 can push the latch bolt 11 out of the case 52. Designated as 72 is a switch which turns on and off upon closing and opening of the door Ia. The dead bolt 27 and the latch bolt 11 may be retracted with a key (not shown) inserted into a key hole 2.

The above-described unlocking device operates as follows. In the condition shown in FIG. 1, the door Ia is closed with the dead bolt 27 being remmained unlocked. In this case, the rotatable stop plate 54 is maintained in the service position because of the engagement by the lever member 56. Therefore, the trigger bolt 19 is maintained in the retracted position, locking the latch bolt 11 as shown in FIG. 9.

If someone in the room turns the door-unlocking switch (not shown) in response to a call, such as by an intercom, of a visitor, the solenoid 65 is energized for a short period of time, e.g. 0.5 sec, whereby the operating plate 63 starts to move upward. Thus, the lever member 56 is rotated clockwise to disengage the lever 56 from the rotatable stop plate 54 and to make the stop plate rotatable. The trigger bolt 19 thus starts to extend through the opening 38 of the strike 29 by the action of the spring 20 (FIG. 7).

In this case, if the pushing strength of the spring 20 is not sufficient or if the actuation time of the solenoid 65 is not sufficiently long, there is a possibility that the solenoid 65 stops operating before the trigger bolt 19 reaches to the extended position. In such a case, the latch bolt 11 remains unlocked and is unable to move even if the pushing member 60 pushes the latch bolt 11. Therefore, the operating plate 63 is unable to reach to the upper position but is displaced downward by gravity as soon as the actuation of the solenoid 65 is stopped.

Even when the operating plate 63 returns to the lower position, however, the trigger bolt 19 still continues to displace toward the extended position. When the trigger bolt 19 extends to the fully extended position, both the engagement between the lever 23 and the latch bolt 11 and between the stoper 41 and the rotatable plate 7 are released, making the door openable by rotation of the outer door knob 3 (FIG. 6).

After lapse of a predetermined period of time from the termination of the previous, first actuation, the solenoid 65 actuates again for another short period of time, e.g. 0.5 sec. Thus, the operating plate 63 is displaced again upward to rotate the push member 60 clockwise about its axis 61 as a result of the engagement between the bent portion 67 of the operating plate and the engaging rod 62 of the pushing member 60. Since the latch bolt 11 becomes moveable, the rotation of the pushing member 60 causes the movement of the latch bolt 11 toward the retracted position together with the trigger bolt 19.

When the operating plate 63 is displaced to the upper position, the engaging plate 70 is engaged by the end portion 71 of the operating plate 63 so that the operating plate 63 is maintained in the upper position even after the termination of the actuation of the solenoid 65. As a consequence, the door Ia is maintained in the state ready for being opened by mere pushing without turning the outer door knob 3.

When the door Ia is opened, the latch 68 of the door frame Ib is displaced to the extended location by the action of the spring 69, so that the bent portion 71 of the operating plate, 63 is disengaged from the engaging plate 70. Thus, the operating plate 63 moves downward by gravity and returns to the state as shown in FIG. 1. The lever member 56 rotates counterclockwise upon the displacement of the operating plate 63 and engages with the stop plate 54 which was already positioned in the service position when the trigger bolt was retracted. When the door Ia is opened, both trigger and latch bolts 19 and 11 are displaced to the extended positions.

A circuit diagram for the above-described unlocking device is shown in FIG. 4, in which the letters Ia, Ib and C indicate a door equipped with the above-described locking apparatus, a door frame equipped with the above-described unlocking device and a room inside of the door Ia, respectively. Designated by the letter EC is an exciting coil for actuating the solenoid 65, $S_2$ is the switch 72, E is an AC source of 100 V, F is a fuse, $R_1$ to $R_7$ are resistors, $D_1$ to $D_4$ are compensating diodes, $LED_1$ to $LED_3$ are light emitting diodes, RC is a full wave rectification circuit, TR is a transformer to a voltage of 12 V, CC is a circuit control DC source composed of a full wave rectification circuit, capacitors, regulators, etc, for supplying a controlled voltage of DC 12 V to respective control circuits, PTC is a photocoupler, $S_1$ is a switch operated by someone within the room C, $INV_1$ and $INV_2$ are invertors, $AMP_1$ to $AMP_3$ are amplifiers, $FF_1$ and $FF_2$ are flip-flop circuits, $OR_1$ and $OR_2$ are OR circuits, IR is an initial reset circuit, BC is a binary counter, OSC is an oscillator, and $R_y$ is a relay coil operating a relay switch $S_3$.

The operation of the circuit diagram shown in FIG. 4 will now be described below, reference being to be made on the timing chart shown in FIG. 5.

At a point in time $t_0$, the door Ia is in a closed position and the switches $S_1$ to $S_3$ are in the conditions shown in FIG. 4. In this state, the AC current from the source E is rectified by the full wave rectifier RC to a DC current. The AC current from the source E is also transformed by the transformer TR, converted into a DC current in the circuit control CC and supplied to respective control circuits. In the recirculating circuit shown, the current recirculates successively through the AC source E, fuse F, rectifer RC, resistor $R_2$, photocoupler PTC, door switch $S_2$, exciting coil EC, rectifier RC and AC source E. The exciting coil EC is not actuated because of the presence of the high resisting resistor $R_2$ connected in series thereto. The light emitting diode $LED_3$ lights to show the operation of the circuit. Since the photocoupler is energized, a minute current is generated therefrom and is fed to the light emitting diode $LED_1$, after being amplified by the amplifier $AMP_1$. Thus, the diode $LED_1$ is lit to show that the door Ia is in the closed position.

The current from the photocoupler PTC is also fed to the invertor $INV_1$, whereby the OR circuit $OR_1$ receives "0" signal. The OR circuit $OR_1$ also receives an output from the initial reset circuit IR so that the OR circuit $OR_1$ generate an output which is fed to the reset terminals of the flip-flop circuits $FF_1$ and $FF_2$, thereby setting both circuits $FF_1$ and $FF_2$ in the initial state.

At a point in time $t_1$, a person in the room C turns the switch $S_1$ on in reply to a call of a visitor, whereupon "1" signal is generated from the invertor $INV_2$ and is fed to a clock terminal CK of the flip-flop circuit $FF_1$. Thus, the flip-flop $FF_1$ is actuated and generates an output $\overline{Q}$ which is fed to the binary counter BC to release its reset terminal R. As a result, a clock pulse of, for example 125 ms, which is generated from the oscillator OSC is counted by the binary counter BC. Meanwhile, the flip-flop $FF_1$ also generates an output Q which is received by the flip-flop $FF_2$. The output Q generated by the flip-flop $FF_2$ is, after being amplified by the amplifier $AMP_2$, fed to the light emitting diode $LED_2$, whereby the diode $LED_2$ is lit to show that the switch $S_1$ is turned on.

At a point in time $t_2$, which is 500 ms after the time $t_1$, an output $Q_2$ is generated for 500 ms from the binary counter BC and fed, after being amplified by the amplifier $AMP_3$, to the relay Ry for closing the switch $S_3$. Because of the low in resistance of the resistor $R_1$, the current flows mainly through the AC source E, fuse F, rectifier RC, resitor $R_1$, switch $S_3$, door switch $S_2$, exciting coil EC, rectifier RC and AC source E, with a minute current streaming through the rectifier RC, resistor $R_2$, photocoupler PTC and switch $S_2$. Thus, the exciting coil EC is energized for the actuation of the solenoid 65 for 500 ms. Then the operating plate 63 starts to displace upward with the simultaneous rotation of the lever member 56, whereby the trigger bolt 19 starts to extend into the opening 38, as described previously.

At a point in time $t_3$ when the binary counter BC stops generating the output $Q_2$, the trigger bolt 19 has not displaced yet to the extended position. Since the switch $S_3$ is opened, the solenoid 65 stops operating. Therefore, the the operating plate 63 is unable to move to the upper position and returns to the lower position.

The binary counter BC generates a second output $Q_2$ for 500 ms at a point in time $t_4$, i.e. after lapse of 500 ms from the time $t_3$. The relay Ry is energized again to actuate the solenoid 65 in the same manner as at the time $t_2$. Since the trigger bolt 19 is already displaced to the extended position, the latch bolt 11 is in the moveable state. Thus, the operating plate 63 is displaced to the upper position with the simultaneous rotation of the pushing member 60. The latch bolt 11 is thus displaced to the retracted position together with the trigger bolt 19.

At a point in time $t_5$, the binary counter BC stops generating the output $Q_2$, causing the termination of the actuation of the solenoid 65. Because of the engagement of the operating plate 63 by the engaging plate 70, however, the operating plate 63 is maintained in the upper position so that the latch and trigger bolts 11 and 19 are maintained in the retracted positions. At this time point $t_5$, the binary counter BC generates a pulse signal $Q_4$ which is fed via 0R circuit $OR_1$ to the reset terminal R of the flip-flop $FF_1$ to stop the operation thereof. Thus, the binary counter BC also stops operating.

When the door Ia is opened at a point in time $t_6$, the switch $S_2$ is opened so that the photocoupler PTC stops operating. Thus, the light emitting diode $LED_1$ is extinguished. Because of the deactivation of the photocoupler PTC, the invertor $INV_1$ generates "1" signal which is fed via OR circuits $OR_1$ and $OR_2$ to the reset R of the flip-flop $FF_1$. Further, the signal from the invertor $INV_1$ is fed via OR circuit $OR_1$ to the reset terminal R of the flip-flop $FF_2$, thereby to extinguish the light emitting diode $LED_2$. Even if the switch $S_1$ is turned on in this condition, neither of the flip-flop circuits $FF_1$ and $FF_2$ can be operated.

When the door Ia is closed at a point in time $t_7$, the switch $S_2$ is turned on, actuating the photocoupler PTC. Thus, the light emitting diode $LED_1$ lights to indicate the closure of the door Ia. Since the OR circuit $OR_1$ receives "0" signal from the inverter $INV_1$, the flip-flop circuits $FF_1$ and $FF_2$ are returned to the same state as at the time $t_0$.

In the foregoing embodiment, the solenoid 65 is twice actuated intermittently each for 0.5 sec. This is, however, only for the purpose of ensuring the positiveness in the unlocking operation. By facilitating the movement of the trigger bolt 19 from the retracted to extended position and/or by prolonging the actuation time of the solenoid 65, the unlocking operation can be achieved with only one actuation of the solenoid 65.

In the above embodiment, the unlocking device is applied for the door locking apparatus shown in FIG. 6. However, it will be understood that the unlocking device according to the present invention is applicable to any type of door lock apparatus, including the apparatus shown in FIG. 11, provided that the apparatus includes a latch bolt and a trigger bolt having functions similar to those of the locking apparatus of FIGS. 6 or 11.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

I claim:

1. In combination with a door supported at one edge by a door frame, said door being locked with a lock apparatus which includes a front plate adapted to be fixed to one side edge of the door; outer and inner door knobs adapted to be secured to outside and inside surfaces of the door, respectively; a latch bolt which is adapted to be displaced between a first position where one end portion of the latch bolt is protruded from the front plate and a second position where the latch bolt is retracted therefrom, which is normally urged to be displaced toward the first position and which is cooperable with the inner door knob so that the latch bolt may be displaced to the second position by rotation of the inner door knob; and a trigger bolt which is adapted to be displaced between an extended position where one end portion of the trigger bolt is protruded from the front plate and retracted position where the trigger bolt is retracted therefrom, which is normally urged to be displaced toward the extended position, which is engageable with the latch bolt so that the movement of the latch bolt from the first to second position necessarily causes the movement of the trigger bolt form the extended to retracted position, and which is capable of acting on the latch bolt when the trigger and latch bolts arae in the retracted and first positions, respectively, so that the latch bolt is locked and prevented from being displaced from the first to second position, the locking of the latch bolt with the trigger bolt being released by displacing the trigger bolt to the extended position; a device for unlocking said door comprising:

a casing having a strike and adapted to be mounted on the door frame with the strike being flush with the surface of the door frame adjacent to the door;

a first opening provided in said strike at a position so that when the door is closed the latch bolt can enter said first opening and can be positioned in said first, protruded position;

a second opening provided in said strike at a position so that when the door is closed the trigger bolt can enter said second opening and can be positioned in said extended position;

stopper means provided within said casing and adapted to be displaced between a service position where the trigger bolt is engaged by said stopper means and is prevented from entering said second opening and from being positioned in said extended position when the door is closed, and a non-service positon where the trigger bolt is permitted to be psoitioned in said extended position;

pushing means provided within said casing, adapted to be displaced between a first location and a second location and capable of displacing the latch bolt which is positioned in said first position to said second position by its movement from said first location to said second location when the door is closed;

means for moving said stopper means between said service and non-service positions; and means for moving said pushing means between said first and second locations.

2. A combination as claimed in claim 1, wherein said pushing means include a rotatable member having its one end portion rotatably supported by the casing and its another end portion engageable with said latch bolt, the rotation of said rotatable member from said first to second location causing the movement of said latch bolt to said second position.

3. A combination as claimed in claim 2, wherein said means for operating said pushing means include an operating plate moveable between an upper position and a lower position, a solenoid connected to said operating plate for moving said operating plate from said lower to said upper position, and an engaging member fixed to said operating plate and engageable with said rotatable member so that the movement of said operating plate from said lower to said upper position causes the movement of said rotatable member from said first to second location.

4. A combination as claimed in claim 3, wherein said stop means include an engaging member fixed to said operating plate for movement therewith and engageable with said trigger bolt so that the movement of said operating plate from said lower to upper position causes the movement of said engaging member from said service to non-service position, said means for operating said pushing means serving also as said means for operating said stop means.

5. A combination as claimed in claim 3, wherein said stop means include a rotatable stop plate rotatably supported, by said casing and engageable with said trigger bolt, a lever member rockably supported to said casing and normally urged to rotate in a direction so that one end thereof is engaged by said operating plate, said lever member having its the other end engageable with said stop plate whereby the movement of said operating plate between the upper and lower positions causes rocking of said lever member with said the other end being disengaged from said stop plate when said operating plate is displaced to said upper position and being engaged by said stop plate to maintain said stop plate in said service position when said operating plate is displaced to said lower position, said means for operating said pushing means serving also as said means for operating said stop means.

6. A combination as claimed in claim 5, further comprising a latch provided in said casing, normally urged to protrude from said casing and engageable by the door when the door is closed so that the latch is protruded from the casing when the door is opened and retracted within the casing when the door is closed, and a supporting plate secured to said latch and engageable with said operating plate positioned in said upper position to maintain said operating plate in said upper position, said supporting plate being disengaged from said operating plate when the door is opened.

7. A lock apparatus for a door movably supported on a door frame, said apparatus comprising:

a first casing adapted to be mounted on the door and having a front plate adapted to be flush with one side edge of the door;

outer and inner door knobs arranged to be secured to both sides on the door and each having a shaft extending within and rotatably supported by the first casing;

a first rotatable plate secured to the shaft of said outer door knob for rotation therewith;

a second rotatable plate secured to the shaft of said inner door knob for rotation therewith;

a retractor slidably mounted within said casing, normally urged to be displaced to one direction and engageable with said first and second rotatable plate so that by rotation of said outer or inner door knob said retractor is displaced in the direction counter to said one direction;

a latch bolt which is normally urged to be displaced in said one direction to a first position where it is protruded from said front plate and which is engageable by said retractor so that said latch bolt is displaced in said counter direction to a second position where it is retracted within said first casing when said retractor is displaced in said counter direction;

a trigger bolt which is adapted to be displaced between an extended position where it is protruded from said front plate and a retracted position where it is retracted within said first casing, which is normally urged to be displaced toward said extended position and which is engageable by said latch bolt so that said trigger bolt is displaced from said extended to said retracted position when said latch bolt is displaced from said first to said second position;

a lever which is rockable mounted within said first casing, which has a first portion engageable by said latch bolt to prevent the latch bolt from being displaced from said first to said second position and which is normally urged to rotate in a first direction and to maintain said first portion in engagement with said latch bolt;

said lever having a second portion engageable by said trigger bolt when said trigger bolt is displaced from the retracted to the extended position so that said lever is rotated in the direction counter to said first direction with said first portion being disengaged from said latch bolt;

said lever having a third portion engageable by said retractor when said retractor is displaced in said one direction so that said lever is rotated in the direction counter to said first direction with said first portion being disengaged from said latch bolt;

a stopper plate member secured to said trigger bolt for movement therewith and having a portion engageable with said first rotatable plate to prevent the rotation of said first rotatable plate when said trigger bolt is positioned in said retracted position;

a second casing having a strike and adapted to be mounted on the door frame with the strike being flush with the surface of the door frame;

a first opening provided in said strike at a position so that when the door is closed the said latch bolt can enter said first opening and can be positioned in said first position;

a second opening provided in said strike at a position so that when the door is closed the trigger bolt can enter said second opening and can be positioned in said extended position;

stopper means provided within said second casing and adapted to be displaced between a service position where said trigger bolt is engageable by said stopper means and prevented from being positioned in said entended position when the door is closed and a non-service position where said trigger bolt is permitted to be positioned in said extend position; and means for moving said stopper means between said service and non-service positions.

* * * * *